US006751828B2

(12) United States Patent
Matschiner et al.

(10) Patent No.: US 6,751,828 B2
(45) Date of Patent: Jun. 22, 2004

(54) DEVICE FOR BUNDLING OBJECTS, SUCH AS CABLE BUNDLES

(75) Inventors: Bernd Matschiner, Kummerfeld (DE); Marco Bräuss, Pinneberg (DE)

(73) Assignee: Hellermann Tyton GmbH, Tornesch (DE)

( * ) Notice: Subject to any disclaimer, the term of this patent is extended or adjusted under 35 U.S.C. 154(b) by 0 days.

(21) Appl. No.: 10/221,122

(22) PCT Filed: Mar. 8, 2001

(86) PCT No.: PCT/EP01/02641

§ 371 (c)(1),
(2), (4) Date: Nov. 25, 2002

(87) PCT Pub. No.: WO01/66432

PCT Pub. Date: Sep. 13, 2001

(65) Prior Publication Data

US 2003/0182767 A1 Oct. 2, 2003

(30) Foreign Application Priority Data

Mar. 9, 2000 (EP) ..... 00105017

(51) Int. Cl.[7] ..... B65D 63/10
(52) U.S. Cl. ..... 24/16 PB; 24/17 AP; 24/30.5 P
(58) Field of Search ..... 24/16 PB, 17 AP, 24/30.5 P; 248/74.3

(56) References Cited

U.S. PATENT DOCUMENTS

| | | | | | |
|---|---|---|---|---|---|
| 3,588,962 | A | * | 6/1971 | Feldberg | 24/16 PB |
| 3,965,538 | A | * | 6/1976 | Caveney et al. | 24/16 PB |
| 4,135,749 | A | * | 1/1979 | Caveney et al. | 24/16 PB |
| 4,688,302 | A | * | 8/1987 | Caveney et al. | 24/16 PB |
| 4,776,067 | A | * | 10/1988 | Sorensen | 24/16 PB |
| 4,875,647 | A | * | 10/1989 | Takagi et al. | 24/16 PB |
| 6,185,792 | B1 | * | 2/2001 | Nelson et al. | 24/16 PB |

FOREIGN PATENT DOCUMENTS

| | | |
|---|---|---|
| DE | 19 66 109 A | 7/1971 |
| EP | 0 075 501 A | 3/1983 |
| FR | 2 054 432 A | 4/1971 |
| WO | WO 90 02284 A | 3/1990 |

* cited by examiner

*Primary Examiner*—Victor Sakran
(74) *Attorney, Agent, or Firm*—Alix, Yale & Ristas, LLP

(57) ABSTRACT

The invention relates to a device for bundling objects, such as cable bundles. The inventive device consists of a toothed tape and a lock that is fixedly connected to an end thereof. The lock is provided with a opening for receiving and holding the free tape end. A tape guiding surface which is situated crosswise in relation to the direction of the tape opening is provided on the side of the lock, whereby said side is opposite the connection to the tape. A portion of the tape which is stretched around an object rests on said surface before entering the tape opening. The tape guiding surface is provided with increased edge ledges.

20 Claims, 2 Drawing Sheets

DEVICE FOR BUNDLING OBJECTS, SUCH AS CABLE BUNDLES

BACKGROUND OF THE INVENTION

The invention relates to a device for binding objects, such as cable bundles, which has a toothed strap and a lock fixed to one end of the strap.

It is based on known devices (EP-A-75 501) which comprise a toothed strap and a lock which is fixed to one end of the strap and has a strap opening for accommodating and securing the free strap end. The strap is guided into the strap opening from that side of the lock which is directed toward the object which is to be bound, and is tensioned from the other side. If the encircled object has a circular boundary in cross section, the strap follows the circular boundary and approaches the lock tangentially. If the diameter is large, the two strap ends approach the lock more or less from opposite sides. It is only in the case of objects having very small dimensions that the angle can drop to 90° or even below. Before the free strap end runs into the strap opening of the lock, it will thus first of all be positioned on a surface of the lock which is directed toward the object which is to be bound, this surface being referred to hereinbelow as the strap-guiding surface. Following this strap-guiding surface, the strap is deflected in the direction of the strap opening. In the case of known cable-binding devices, this is the bottom edge of the lock which is reached first of all by the free strap end.

When the strap is tensioned, it is necessary to overcome the friction which acts, on the one hand, between the strap and the lock (mainly in the region of the deflection of the strap) and, on the other hand, between the strap and the object which is to be bound. This friction may differ to a fair extent from case to case. This has a disruptive effect on the effort of producing a predetermined tensioning in the strap part encircling the object as a result of determining the tensioning force. The friction to which the surface of the object which is to be bound is subjected by the strap, said friction differing from case to case, may also affect the strap tensioning. Also regarded as being disadvantageous is the fact that the act of the strap being tensioned sliding over the surface of the object which is to be bound may damage the surface of the object (for example cable insulations).

SUMMARY OF THE INVENTION

The invention eliminates or moderates these disadvantages. Provision is accordingly made for the side borders of the strap-guiding surface to be provided with raised border ridges. This results in the latter forming a lateral guide for the strap moved over the guiding surface. This ensures that the strap reaches the deflecting surface, which deflects the strap into the strap opening following the strap-guiding surface, precisely perpendicularly to the axis of curvature of said deflecting surface. This is because the invention has found that a reason for different frictional forces between the strap and lock resides in the fact that the strap sometimes runs askew into the lock.

Furthermore, the raised side borders of the strap-guiding surface form an additional support, alongside the strap, for the surface of the object which is to be bound. This means that the force by which the strap, during its movement relative to the surface of the object which is to be bound, butts against said surface are reduced, as a result of which the risk of damage is also reduced.

The lateral-guide function of the border ridges requires the distance between the latter not to exceed the width of the strap to any significant extent. Normally, the distance between them should exceed the width of the straps by no more than 10%. A distance of around 3 to 7% above the width of the strap is preferred.

The height of the border ridges above the guiding surface in order for said border ridges to provide an effective support in relation to the surface of the object depends on the compliance of the object. The more flexible is the object, the smaller is the height required for the border ridges. For binding devices which serve for binding cable harnesses, it has proven successful if the greatest height of the border ridges above the guiding surface is at least half the thickness of the strap. In this context, it is expedient if, on the side of the strap which is to be directed toward the object which is to be bound, the borders of the strap are provided with a rounding or bevelling, of which the width, as seen from each side, is equal to at least approximately half the strap thickness.

The invention has found that, in order to reduce the friction between the strap and the lock, it is expedient for the strap to pass in the direction of the strap opening by way of the largest possible radius of curvature. The strap-guiding surface should thus pass into the surface of the strap opening by way of a curvature, of which the radius is equal to at least half the strap thickness.

The strap-guiding surface is preferably elongate and encloses an obtuse angle with the direction of the strap opening, said obtuse angle expediently being greater than 110, and further preferably being greater than 120°.

Good results can be achieved by a strap-guiding surface which runs approximately rectilinearly in longitudinal section.

The strap-guiding surface, in relation to the object which is to be bound, should assume a direction which corresponds to the direction of the strap running toward the lock, that is to say approximately a circumferential or tangential direction. This requires a certain alignment of this surface with that region in which the other strap end is fixed to the lock. The direction of the strap-guiding surface is preferably aligned with this region. If the center point of this region is defined as the point of intersection between the center line of the strap extending from the lock in the non-tensioned state and the center line of the wall on which the strap is fastened integrally, the direction of a significant part of the strap-guiding surface should be aligned with this point, that is to say the extension of the strap-guiding surface should run past said point at a distance which is no greater than half the strap thickness.

BRIEF DESCRIPTION OF THE DRAWING

The invention is explained in more detail hereinbelow, with reference to the drawing, which illustrates an advantageous exemplary embodiment of the invention and in which.

DETAILED DESCRIPTION OF THE PREFERRED EMBODIMENT

Figure 1:
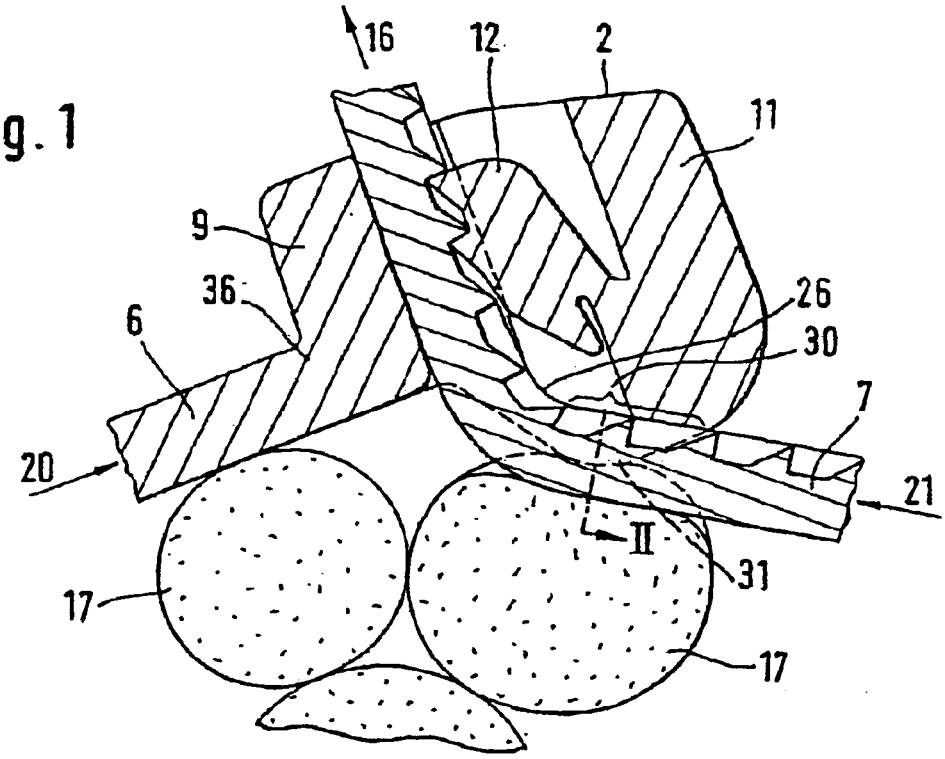
FIG. 1 shows a partial longitudinal section through an arrangement comprising the strap lock, the free strap end retained therein, and part of a cable bundle encircled by the strap.

The binding device has a strap 1 and a lock 2, which are connected integrally to one another and consist of tough and resilient plastic such as polyamide. The strap 1 is essentially smooth on the side 3 and, on its opposite side, has a toothing formation 4 between the side borders 5.

The lock encloses the strap opening 8 with four walls, namely a wall 9, to which the end 6 of the strap 1 is connected, two side walls 10 and a wall 11, which bears a detent 12 which projects into the strap opening 8. Said detent is connected to the wall 11 via a bending articulation 13 and has teeth 14, which interact with the toothing formation 4 of the strap 1 when the end of the latter is guided through the strap opening 8 in the manner illustrated in FIG. 1. The direction 15 in which the strap is moved through the strap opening 8 is defined by the opposing restraining action of the detent 12. The side from which the free strap end 7 is introduced into the strap opening 8 is directed toward the object which is to be bound. It is assumed in FIG. 1 that the object which is to be bound is a cable bundle comprising a number of cables 17.

For use purposes, the strap 1 is placed around the object 17 which is to be bound, and its free end 7 is tensioned in arrow direction 16 by means of a suitable tool. As soon as the desired band tensioning has been reached, that end of the strap which projects beyond the lock 2 is cut off. Since this operation and tools which are suitable for this purpose are known, there is no need for any detailed illustration or explanation here.

In a tensioned state, the strap butts against the surface of the cross section of the object. In most cases, this is a circular cross section. As a result, the end 6, which is fastened on the lock 2, and the free strap end 7 run toward the lock 2 approximately in a circumferential direction or tangentially in the direction of the arrows 20, 21. Depending on the diameter of the object, these directions 20, 21 enclose an obtuse angle with one another, which in most cases is between 130 and 170°. For the cable tie illustrated in the drawing, it is assumed that this angle is between 140 and 160°.

The surfaces of the strap opening 8 have the task of guiding the strap such that the toothing formation 4 and the teeth 14 of the detent can interact properly. They are formed by the inner surface 22 of the wall 9, the inner surfaces 23 of the side walls 10 and the surfaces 24, which are formed by supporting ridges 25 projecting from the wall 11 on both sides alongside the detent 12. Since the direction 21 in which the strap end 7 approaches the lock 2 differs from the direction 15, 16 of the strap opening 8, these supporting ridges 25 also form a region of curvature 26, which supports the strap in the region of its deflection. The curvature of the region of curvature 26 follows a circle arc around the axis of curvature 32.

Up to this point, the arrangement shown may be regarded as being known. According to the invention, the region of curvature 26 has arranged in front of it a strap-guiding surface 30, on which the strap positions itself and which is enclosed on both sides by border ridges 31, the distance between which is not much greater than the width of the strap 1. The border ridges 31 provide the latter with a lateral guide, which ensures that said strap runs into the region of curvature perpendicularly to the axis of curvature 32. A skewed position, which results in unpredictable ratios of friction between the strap and lock, is thus avoided. A favorable introduction of forces into the strap and into the lock is also aided as a result. The device is thus able to absorb higher forces.

Figure 2:
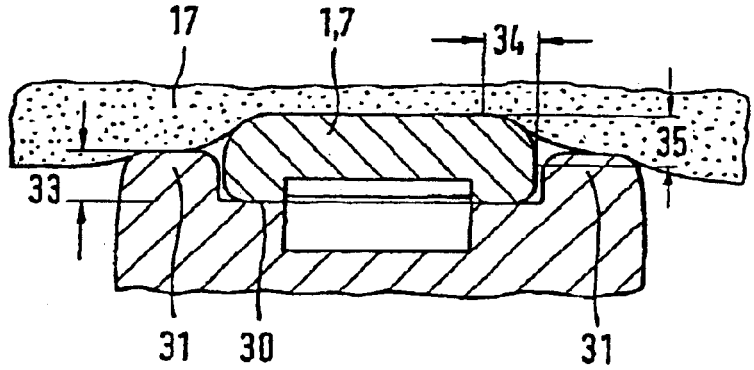
FIG. 2 shows a cross section along line II from FIG. 1.
Figure 3:
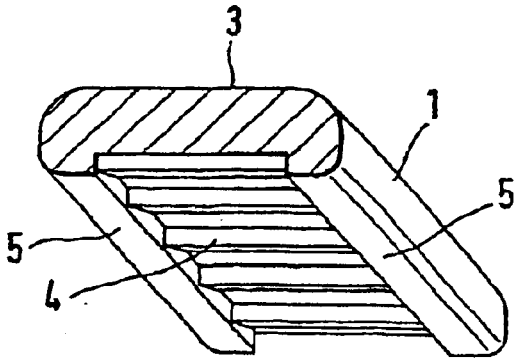
FIG. 3 shows the perspective view of a strap part.
Figure 4:
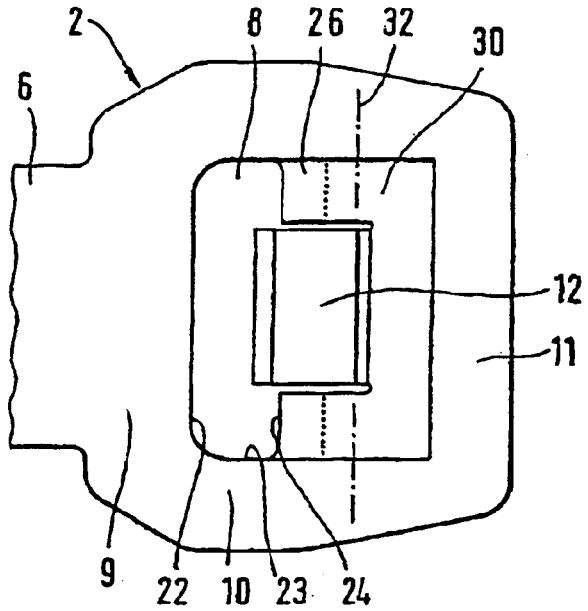
FIG. 4 shows a view of the lock on its side which is to be directed toward the object which is to be bound.
Figure 5:
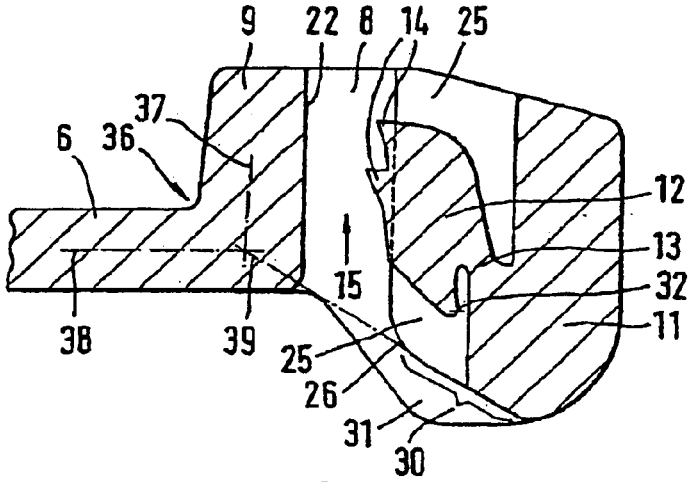
FIG. 5 shows a longitudinal section of the lock.
Figure 6:
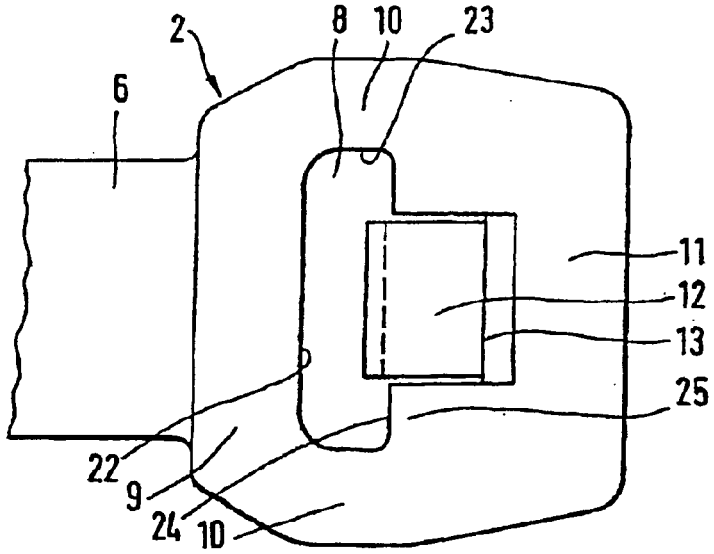
FIG. 6 shows a view of the lock on its side which is directed away from the object which is to be bound.

If the object which is to be bound—a cable 17 in the case of FIGS. 1 and 2—is sufficiently flexible, it will deform when butting against the strap 1. Since the edges of the latter are well rounded, this does not normally have any adverse effect. If, however, in the region of the strap end 7, which is drawn into the lock during the tensioning operation, the deformation of the object 20 and the movement of said object relative to the strap end 7 combine, the object may, in certain circumstances, be damaged. According to the invention, the border ridges 31 on both sides of the strap end 7 in the region of the strap-guiding surface are utilized in order to reduce this risk by virtue of their height 33 being selected such that the object 20 can also be supported on these border ridges 31 on both sides of the strap 1. For this purpose, the height 33 of the border ridges is to be at least approximately half the thickness of the strap. It is also possible for it to be higher and to reach the order of magnitude of the strap thickness or even to go beyond the latter.

The supporting action of the border ridges 31 is supplemented by the rounding of the edges of the strap. In the plan view of the strap, the width 34 of this rounding is greater than half the strap thickness. The same applies to the width 35 thereof in side view. As a result of the size of this rounding and of the supporting action of the border ridges 31, a possible detrimental tensioning peak in the object 20 in the region of the edges of the strap 1 is avoided.

In order that the strap can be supported on the strap-guiding surface 30 over the largest possible surface area, said strap-guiding surface is of elongate configuration, e.g. is preferably greater than half the strap thickness. It is aligned with the region 36, in which the strap end 3 is connected to the wall 9 of the lock. In fact, it is directed toward the center point of this region, said center point being marked by the point of intersection between the center line 38 of the strap end 3 and the center line 37 of the wall 9. The distance at which the continuation line 39, depicted by chain-dotted lines, of the strap-guiding surface 30 passes this point should be no greater than the strap thickness, preferably no greater than half the strap thickness.

What is claimed is:

1. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that, on a side of the strap, which side is to be directed toward the object which is to be bound, the borders of the strap are provided with a rounding or bevelling, of which the width, as seen from each side, is equal to at least approximately half the strap thickness.

2. The device as claimed in claim 1, characterized in that the distance between the border ridges exceeds the width of the strap by no more than 10%.

3. The device as claimed in claim 2, characterized in that the greatest height of the border ridges above the guiding surface is at least half the thickness of the strap.

4. The device as claimed in claim 2, characterized in that the strap side which is directed toward the object does not have any teeth.

5. The device as claimed in claim 2, characterized in that the strap-guiding surface is elongate and encloses an obtuse angle with the direction of the strap opening.

6. The device as claimed in claim 1, characterized in that the greatest height of the border ridges above the guiding surface is at least half the thickness of the strap.

7. The device as claimed in claim 6, characterized in that the strap side which is directed toward the object does not have any teeth.

8. The device as claimed in claim 6, characterized in that the strap-guiding surface is elongate and encloses an obtuse angle with the direction of the strap opening.

9. The device as claimed in claim 1, characterized in that the strap side which is directed toward the object does not have any teeth.

10. The device as claimed in claim 1, characterized in that the strap-guiding surface passes in the direction of the strap opening by way of a curvature, of which the radius is equal to at least half the strap thickness.

11. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that the strap-guiding surface passes in the direction of the strap opening by way of a curvature, of which the radius is equal to at least half the strap thickness.

12. The device as claimed in claim 11, characterized in that the strap-guiding surface is elongate and encloses an obtuse angle with the direction of the strap opening.

13. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that the direction of a significant part of the strap-guiding surface is aligned with the fastening region of the strap.

14. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the distance between the border ridges exceeds the width of the strap by no more than 10%, the strap-guiding surface being located transversely to the direction of the strap opening; and said device further characterized in that on the a side of strap, which side is to be directed toward the object which is to be bound, the borders of the strap are provided with a rounding or bevelling, of which the width, as seen from each side, is equal to at least approximately half the strap thickness.

15. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that on a side of the strap, which side is to be directed toward the object which is to be bound, the borders of the strap are provided with a rounding or bevelling, of which the width, as seen from each side, is equal to at least approximately half the strap thickness, the greatest height of the border ridges above the guiding surface is at least half the thickness of the strap.

16. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that, on a side of the strap, which side is to be directed toward the object which is to be bound, does not have any teeth, and the borders of the strap are provided with a rounding or bevelling, of which the width, as seen from each side, is equal to at least approximately half the strap thickness.

17. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the distance between the border ridges exceeds the width of the strap by no more than 10%, the strap-guiding surface being located transversely to the direction of the strap opening; and said device further characterized in that the strap-guiding surface passes in the direction of the strap opening by way of a curvature, of which the radius is equal to at least half the strap thickness.

18. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that the strap-guiding surface passes in the direction of the strap opening by way of a curvature, of which the radius is equal to at least half the strap thickness, the greatest height of the border ridges above the guiding surface is at least half the thickness of the strap.

19. A device for binding objects, such as cable bundles, comprising a toothed strap having side borders and a lock fixed to an end of the strap by a connection, said lock having a strap opening for accommodating and securing a free strap end, the lock having a side which is located opposite the connection to the strap and forms a strap-guiding surface having raised border ridges, the strap-guiding surface being located transversely to the direction of the strap opening; and said device further characterized in that on a side of the strap, which side is to be directed toward the object which is to be bound, does not have any teeth, and the strap-guiding surface passes in the direction of the strap opening by way of a curvature, of which the radius is equal to at least half the strap thickness.

20. An apparatus for binding articles, such as bunched cables comprising a toothed strap and a lock securely connected to one end thereof, which lock has a strap opening to receive and retain the free strap end and on the side opposite the connection to the strap forms a strap-guide surface which is disposed transversely to the direction of the strap opening and the side edges of which are provided with raised edge strips, characterized in that the strap-guide surface is elongated and forms with the direction of the strap opening an obtuse angle, in that the direction of an essential part of the strap-guide surface extends at a distance amounting at maximum to half the strap thickness past a point at which the centre line of the strap proceeding from the lock in the relaxed state and the centre line of the wall intersect, on which the strap is secured, and in that the strap-guide surface merges with a curvature, the radius of which is at least equal to one half the strap thickness, into the direction of the strap opening.

* * * * *